US010208546B2

(12) United States Patent
Krid et al.

(10) Patent No.: US 10,208,546 B2
(45) Date of Patent: Feb. 19, 2019

(54) STABILIZER ASSEMBLY

(71) Applicant: Schlumberger Technology Corporation, Sugar Land, TX (US)

(72) Inventors: Karim Krid, Clamart (FR); Jose Medina, Clamart (FR); Corentin Guyou, Clamart (FR); Clement Texier, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 306 days.

(21) Appl. No.: 15/292,278

(22) Filed: Oct. 13, 2016

(65) Prior Publication Data

US 2017/0114596 A1 Apr. 27, 2017

(30) Foreign Application Priority Data

Oct. 22, 2015 (EP) ..... 15290275

(51) Int. Cl.
*E21B 17/10* (2006.01)
*E21B 3/00* (2006.01)

(52) U.S. Cl.
CPC ..... *E21B 17/1078* (2013.01); *E21B 3/00* (2013.01)

(58) Field of Classification Search
CPC ..... E21B 17/1078; E21B 17/1064; E21B 17/1057; E21B 17/1042; E21B 17/10; E21B 17/1007; E21B 17/1071; E21B 47/01
See application file for complete search history.

(56) References Cited

U.S. PATENT DOCUMENTS 2,572,307 A * 10/1951 Brown ..... E21B 17/04 175/294
2,715,552 A * 8/1955 Lane ..... E21B 17/1042 175/325.5
3,276,824 A * 10/1966 Carter ..... E21B 17/1078 175/325.3
3,754,609 A * 8/1973 Garrett ..... E21B 17/042 175/323

(Continued)

OTHER PUBLICATIONS

Search Report issued in corresponding European application 15290275.5 dated Oct. 12, 2016. 6 pages.

*Primary Examiner* — Daniel P Stephenson

(57) ABSTRACT

A stabilizer assembly for incorporation in a drill string. The stabilizer assembly includes a tubular member and a stabilizer sleeve slidably disposed about the tubular member. The tubular member has a first castellated portion extending externally around the tubular member, and the stabilizer sleeve has a second castellated portion engaging the first castellated portion. The tubular member includes a first shoulder extending externally around the tubular member, and the stabilizer sleeve further includes a second shoulder extending internally around the stabilizer sleeve. The first and second shoulders at least partially define an annular space between the tubular member and the stabilizer sleeve. A key is disposed within the annular space such that an axial load path between the tubular member and the stabilizer sleeve is substantially through the first and second shoulders and the key and substantially not through the first and second castellated portions.

15 Claims, 8 Drawing Sheets

(56) References Cited

U.S. PATENT DOCUMENTS 4,877,092 A * 10/1989 Helm ..... E21B 7/068 175/74
4,984,633 A * 1/1991 Langer ..... E21B 17/1078 166/173
5,180,021 A * 1/1993 Champion ..... E21B 7/06 175/325.2
5,740,862 A * 4/1998 Sable ..... E21B 17/1064 166/241.2
5,833,018 A * 11/1998 von Gynz-Rekowski ..... E21B 17/1064 175/325.3
6,666,267 B1 * 12/2003 Charlton ..... E21B 17/1078 166/241.1
7,004,266 B2 * 2/2006 Russell ..... E21B 17/1014 166/240
7,159,668 B2 * 1/2007 Herrera ..... E21B 17/1057 166/241.6
7,392,861 B2 * 7/2008 Fouillou ..... E21B 47/01 175/325.1
7,409,758 B2 * 8/2008 Le ..... E21B 17/1007 166/212
8,511,377 B2 * 8/2013 Casassa ..... E21B 17/1042 166/241.6
9,217,301 B1 * 12/2015 Latham ..... E21B 17/1078
2003/0106719 A1 * 6/2003 Herrera ..... E21B 17/1057 175/325.2
2005/0205252 A1 * 9/2005 Tulloch ..... E21B 37/02 166/173
2006/0070731 A1 4/2006 Fouillou et al.
2015/0027713 A1 * 1/2015 Penisson ..... E21B 37/02 166/311
2017/0114596 A1 * 4/2017 Krid ..... E21B 17/1078
2018/0066480 A1 * 3/2018 Savage ..... E21B 4/02

* cited by examiner

STABILIZER ASSEMBLY

CROSS-REFERENCE TO RELATED APPLICATIONS

This application claims the benefit of European Patent Application No. 15290275.5, titled "Stabilizer Assembly", filed on Oct. 22, 2015, the entire content of which is incorporated by reference into the current application.

BACKGROUND OF THE DISCLOSURE

A stabilizer is utilized in a drill string to provide a predetermined standoff between a neighboring component of the drill string and a wall of a wellbore in which the drill string is disposed. The stabilizer generally includes a number of blades extending longitudinally, helically, or otherwise along a body of the stabilizer, thus permitting wellbore fluids and drilling debris to travel past the stabilizer while providing the predetermined standoff.

Some stabilizers include a sleeve positioned around a collar of the stabilizer and comprising the blades. The sleeve may be maintained in a predetermined axial and rotational position relative to the collar by corresponding castellated and/or other interlocking features of the sleeve and the collar. However, axial loads and/or other forces experienced during drilling operations and transferred between the sleeve and the collar can mechanically compromise the interlocking features. For example, areas of contact between the interlocking features of the sleeve and the collar may experience high cyclic loading caused by bending and relative movement of the sleeve and the collar, thus accelerating wear and damage of the interlocking features and inducing early catastrophic failures.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a stabilizer assembly for incorporation in a drill string. The stabilizer assembly includes a tubular member and a stabilizer sleeve slidably disposed about the tubular member. The tubular member includes a first castellated portion extending externally around the tubular member, and the stabilizer sleeve includes a second castellated portion engaging the first castellated portion. The tubular member also includes a first shoulder extending externally around at least a portion of the tubular member. The stabilizer sleeve also includes a second shoulder extending internally around at least a portion of the stabilizer sleeve. The first and second shoulders at least partially define an annular space between the tubular member and the stabilizer sleeve. The stabilizer sleeve also includes a key disposed within the annular space such that an axial load path between the tubular member and the stabilizer sleeve is substantially through the first and second shoulders and the key and substantially not through the first and second castellated portions.

The present disclosure also introduces a method of assembling a stabilizer assembly for incorporation in a drill string. The stabilizer assembly includes a tubular member and a stabilizer sleeve. The method includes sliding the stabilizer sleeve axially along the tubular member to a first axial position, inserting a key into an at least partially annular space between the tubular member and the stabilizer sleeve while the stabilizer sleeve is at the first axial position, and sliding the stabilizer sleeve axially along the tubular member to a second axial position at which the key contacts a first shoulder, extending externally around at least a portion of the tubular member, and a second shoulder, extending internally around at least a portion of the stabilizer sleeve.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
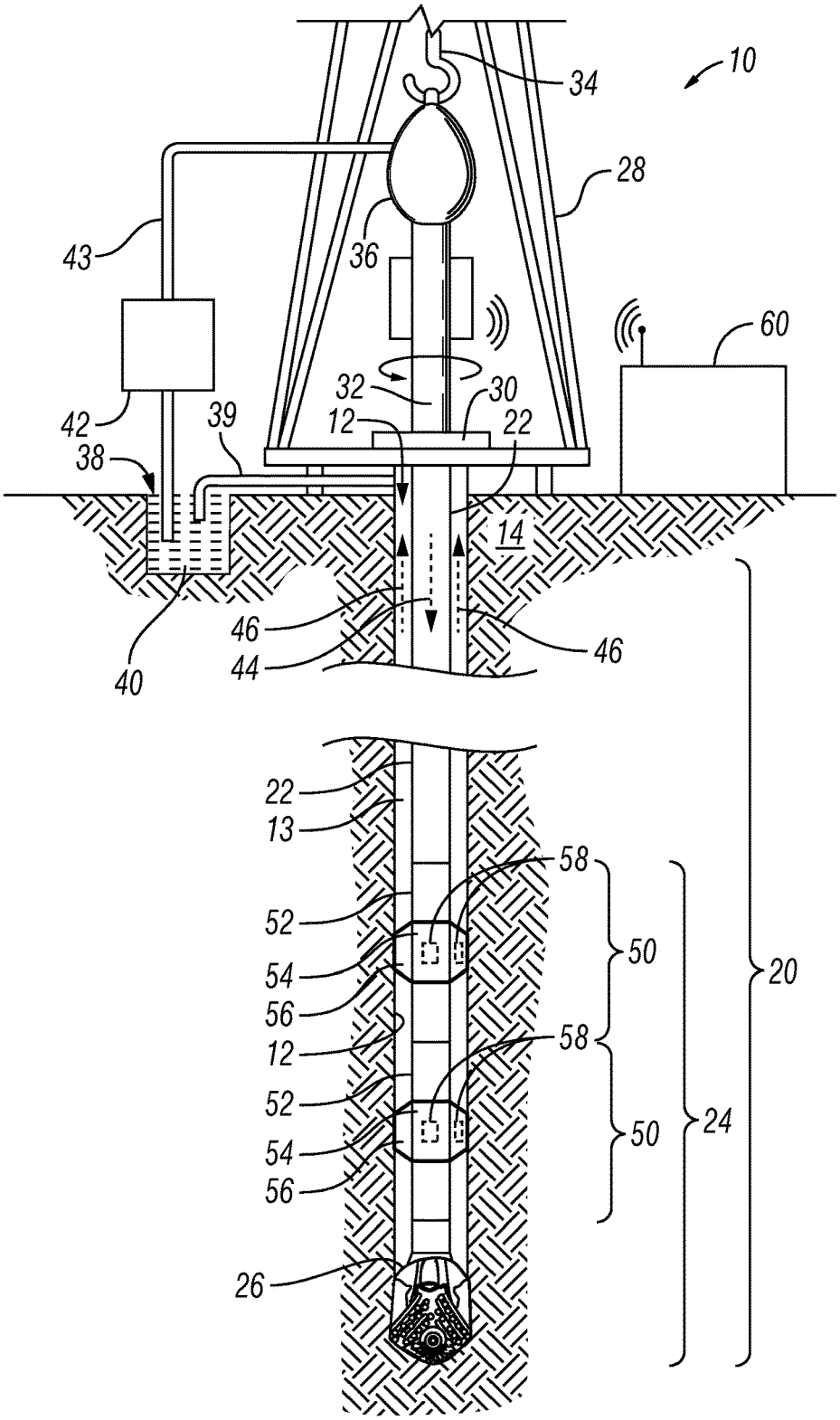
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a wellsite system 10 according to one or more aspects of the present disclosure. The wellsite system 10 depicted in FIG. 1 represents an example environment in which one or more aspects described below may be implemented. It is also noted that although the wellsite system 10 is depicted in FIG. 1 as an onshore implementation, it is understood that the aspects described below are also generally applicable to offshore implementations.

The wellsite system 10 is depicted in FIG. 1 in relation to a wellbore 12 formed in a subterranean formation 14 by rotary and/or directional drilling. The wellsite system 10 includes a platform, rig, derrick, and/or other wellsite structure 28 positioned over the wellbore 12. A drill string 20, including a bottom-hole assembly (BHA) 24, is suspended from the wellsite structure 28 within the wellbore 12 via conveyance means 22. The conveyance means 22 may comprise drill pipe, wired drill pipe (WDP), tough logging condition (TLC) pipe, coiled tubing, and/or other means of conveying the BHA 24 within the wellbore 12.

The BHA 24 may include or be coupled to a drill bit 26 at its lower end. Rotation of the drill bit 26 advances the BHA 24 into the formation 14 to form the wellbore 12. For example, a kelly 32 connected to the upper end of the conveyance means 22 may be rotated by a rotary table 30 on the rig floor. The kelly 32, and thus the conveyance means 22, may be suspended from the wellsite structure 28 via a hook 34 and swivel 36 in a manner permitting rotation of the kelly 32 and the conveyance means 22 relative to the hook 34. However, a top drive (not shown) may be utilized instead of or in addition to the kelly 32 and rotary table 30 arrangement.

The wellsite system 10 also comprises a pit, tank, and/or other surface container 38 containing drilling fluid 40. A pump 42 delivers the drilling fluid 40 to the interior of the conveyance means 22, such as via a fluid delivery conduit 43 extending between the pump 42 and the swivel 36, internal flow passages (not shown) of the swivel 36, and the interior of the kelly 32, thus inducing the drilling fluid 40 to flow downhole through the conveyance means 22, as indicated by directional arrow 44. The drilling fluid 40 exits ports (not shown) in the drill bit 26 and then circulates uphole through an annulus 13 defined between the outside of the conveyance means 22 and the wall of the wellbore 12, as indicated by direction arrows 46. In this manner, the drilling fluid 40 lubricates the drill bit 26 and carries formation cuttings up to the surface, where the drilling fluid 40 is returned to the surface container 38 via a fluid return line 39 for recirculation.

Additional surface equipment 60 includes a controller and/or other processing system for controlling the BHA 24 and perhaps other portions of the wellsite system 10. The surface equipment 60 also includes interfaces for receiving commands from a human operator and communicating with the BHA 24, such as via mud-pulse telemetry. The surface equipment 60 also stores executable programs and/or instructions, including for implementing one or more aspects of the methods described herein.

The BHA 24 includes one or more stabilizer assemblies 50. Each stabilizer assembly 50 comprises a sleeve 54 disposed about a drill collar or other tubular member 52. The sleeve 54 includes one or more external blades 56 providing for standoff between the tubular member 52 and the wall of the wellbore 12.

The tubular member 52 and/or the sleeve 54 of one or more of the stabilizer assemblies 50 may contain various downhole sensors 58. The sensors 58 may include acoustic sensors, density sensors, directional drilling sensors, electromagnetic (EM) sensors, formation evaluation sensors, gravity sensors, logging-while-drilling (LWD) sensors, magnetic resonance sensors, measurement-while-drilling (MWD) sensors, neutron sensors, nuclear sensors, porosity sensors, resistivity sensors, seismic sensors, and/or surveying sensors, although other downhole sensors are also within the scope of the present disclosure.

Figure 2:
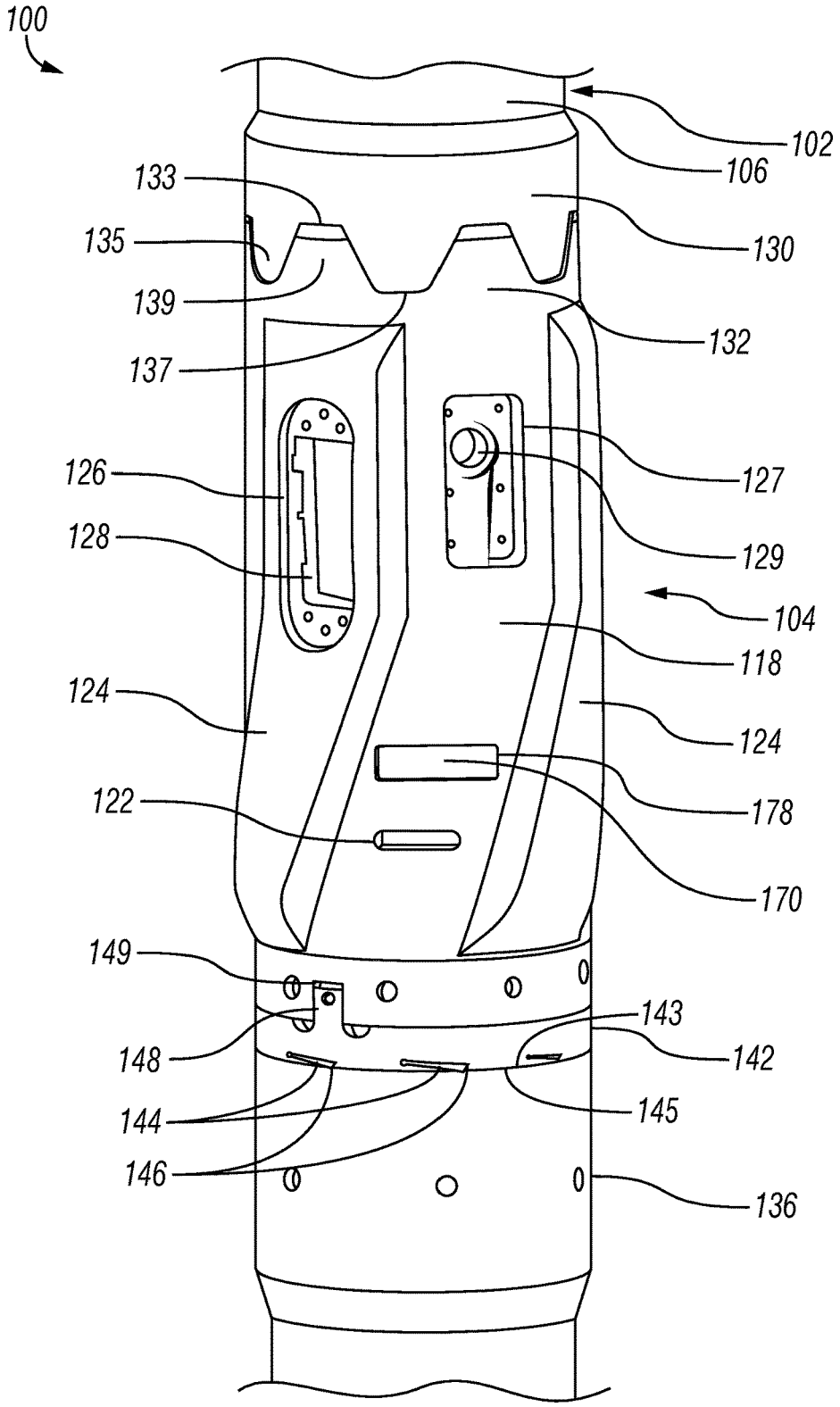
FIG. 2 is a perspective view of a portion of an example implementation of the apparatus shown in FIG. 1 according to one or more aspects of the present disclosure.
Figure 3:
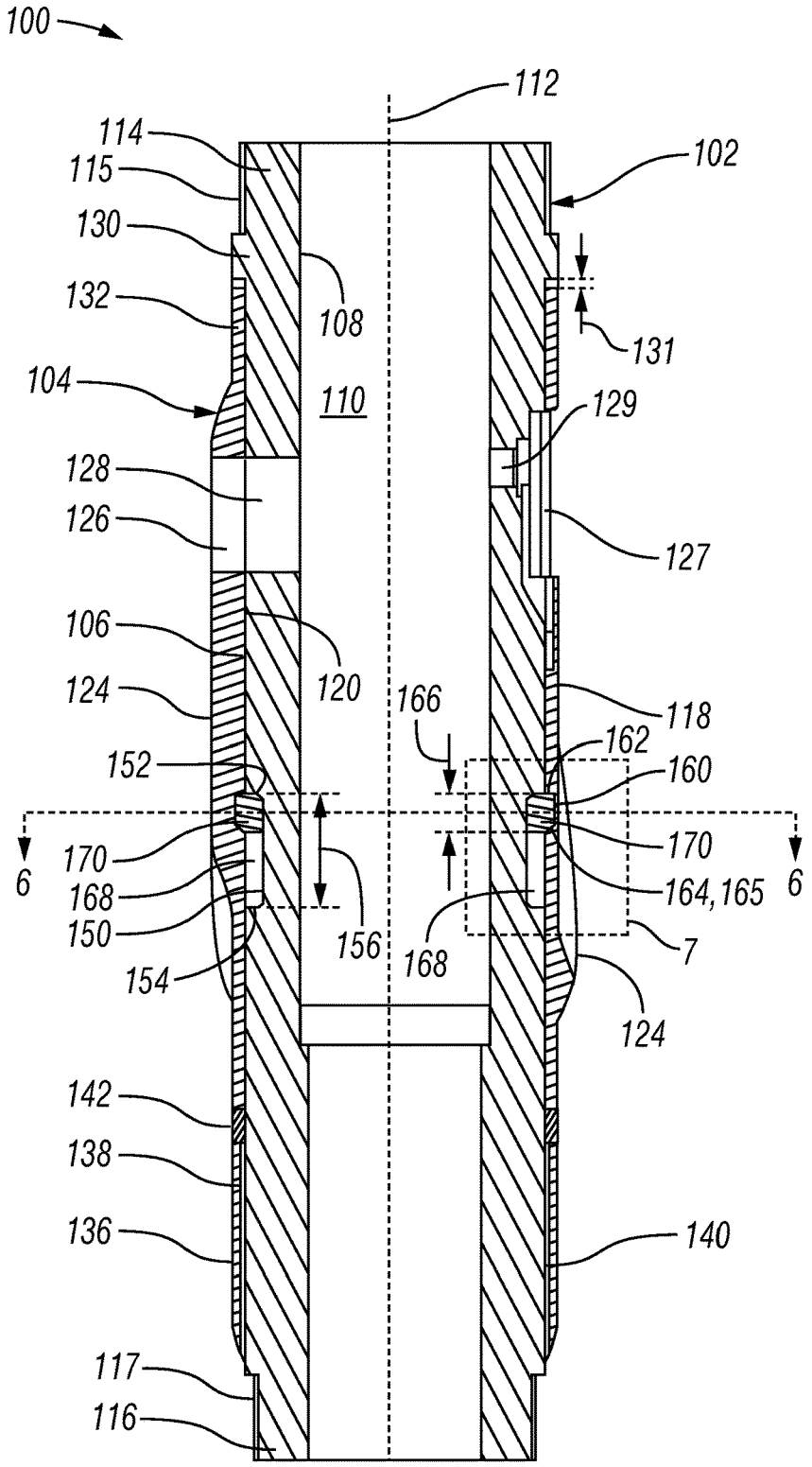
FIG. 3 is a sectional view of a portion of the apparatus shown in FIG. 2.

FIG. 2 is a perspective view of a portion of an example implementation of the stabilizer assembly 50 shown in FIG. 1, designated in FIG. 2 by reference numeral 100, according to one or more aspects of the present disclosure. FIG. 3 is a sectional view of the stabilizer assembly 100 shown in FIG. 2. The following description refers to FIGS. 1-3, collectively.

The stabilizer assembly 100 comprises a drill collar or other tubular member 102 and a stabilizer sleeve 104 slidably disposed about the tubular member 102. An inner surface 108 of the tubular member 102 at least partially defines a longitudinal bore 110 extending through the tubular member 102. An uphole end 114 of the tubular member 102 may include an interface 115 comprising means for mechanically and fluidly coupling with a corresponding interface of a neighboring portion of the BHA 24 or a neighboring section of the drill string 20. A downhole end 116 of the tubular member 102 may include an interface 117 comprising means for mechanically and fluidly coupling with a corresponding interface of another neighboring portion of the BHA 24. The interfaces 115, 117 may comprise threads, fasteners, box-pin couplings, and/or other coupling means.

The stabilizer sleeve 104 is generally tubular, having an inner surface 120 at least partially defining a longitudinal bore extending through the stabilizer sleeve 104 in a manner permitting the stabilizer sleeve 104 to be slidably disposed about the outer surface 106 of the tubular member 102. A plurality of blades 124 extends externally along the stabilizer sleeve 104. The blades 124 may each extend substantially longitudinally along the stabilizer sleeve 104 or, as depicted in FIG. 2, at least a portion of each blade 124 may extend substantially helically around the stabilizer sleeve 104, among other example implementations within the scope of the present disclosure that permit the passage of drilling fluid and debris between the stabilizer assembly 100 and the sidewall of the wellbore 12.

The stabilizer sleeve 104 may comprise one or more openings 126 extending radially through one or more of the blades 124 and/or one or more openings 127 extending radially through other portions of the substantially cylindrical outer surface 118 of the stabilizer sleeve 104 between ones of the blades 124. The openings 126, 127 may each be for receiving and/or retaining one or more of the sensors 58 described above. However, at least a portion of one or more of the sensors 58 may also or instead be retained at least partially within one or more cavities or openings 128, 129 aligned with the openings 128, 129, respectively, and extending radially into or through a wall of the tubular member 102. For example, in implementations in which a sensor 58 is located wholly within the tubular member 102, the corresponding opening 126, 127 may be open to the wellbore 12 or comprise therein a window (not shown) of transparent (e.g., optically transparent, EM transparent, etc.) material, translucent material, low-density material, and/or other material that may permit the passage of energy and/or signals. For example, the window may substantially comprise sapphire.

The tubular member 102 and the stabilizer sleeve 104 are locked or otherwise engaged relative to each other to limit relative movement and substantially maintain the stabilizer sleeve 104 in position relative to the tubular member 102 during drilling operations, including to maintain alignment between the openings 126, 127 and the openings 128, 129, respectively. For example, as most clearly shown in FIG. 2, the tubular member 102 comprises a castellated portion 130 including alternating slots 133 and protrusions 135 collectively extending around the tubular member 102, and the stabilizer sleeve 104 comprises a corresponding castellated portion 132 including alternating slots 137 and protrusions 139 collectively extending around the stabilizer sleeve 104. The slots 133 of the castellated portion 130 receive the protrusions 139 of the stabilizer sleeve 104, and the slots 137 of the stabilizer sleeve 104 receive the protrusions 135 of the tubular member, thus engaging the tubular member 102 and the uphole end of the stabilizer sleeve 104. Although the castellated portions 130, 132 shown in FIG. 2 are depicted as comprising substantially trapezoidal slots and protrusions 133, 135, 137, 139, it is understood that rectangular, square, curved, and/or otherwise shaped slots and protrusions 133, 135, 137, 139 also within the scope of the present disclosure.

The downhole end of the stabilizer sleeve 104 may be secured relative to the tubular member 102 by various means. For example, in the example implementation shown in FIG. 2, the stabilizer assembly 100 also comprises a sliding ring 142 adjacent the stabilizer sleeve 104, and a retaining ring 136 adjacent the sliding ring 142.

The sliding ring 142 is a generally annular member comprising one or more tabs 148 extending into one or more corresponding recesses 149 of the downhole end of the stabilizer sleeve 104. As with the engagement of the castellated portions 130, 132, engagement of the tabs 148 of the sliding ring 142 with the recesses 149 of the stabilizer sleeve 104 may reduce or prevent rotation of the stabilizer sleeve 104 relative to the tubular member 102.

The retaining ring 136 is a generally annular member comprising internal threads 138 that engage external threads 140 of the tubular member 102. The retaining ring 136 is assembled onto the tubular member 102 by rotating the retaining ring 136 relative to the tubular member 102 until reaching a predetermined torque resulting from axial contact between the retaining ring 136 and the sliding ring 142, between the sliding ring 142 and the stabilizer sleeve 104, and between the castellated portions 130, 132. Consequently, the retaining ring 136 applies an axial biasing force against the sliding ring 142, thereby maintaining the sliding ring 142 in contact with the stabilizer sleeve 104, and maintaining the engagement between the castellated portions 130, 132.

The retaining ring 136 may be retained in the so assembled position by various means. For example, one or more set screws, pins, and/or other fastening means may lock the retaining ring 136 relative to the tubular member 102 and/or otherwise prevent unthreading of the retaining ring 136 from the assembled position. In the example implementation depicted in FIGS. 2 and 3, the retaining ring 136 is prevented from rotation away from the assembled position by the engagement of a plurality of flexible members 144 at the downhole axial end of the sliding ring 142 with corresponding recesses 146 in the uphole axial end of the retaining ring 136. Each flexible member 144 extends from an otherwise substantially planar surface 143 that substantially forms the downhole axial end of the sliding ring 142. Prior to assembly of the stabilizer assembly 100, each flexible member 144 has a natural position in which the flexible member 144 protrudes away from the surface 143. However, each flexible member 144 is deflectable towards a deflected position in which the flexible member 144 is substantially flush with the surface 143, thus creating a spring force urging the flexible member 144 towards the natural position. During assembly of the stabilizer assembly 100, the retaining ring 136 is rotated about the tubular member 102 until the retaining ring 136 contacts the sliding ring 142, thereby deflecting each flexible member 144 away from the natural position towards the deflected position. However, slightly further (or less) rotation brings each flexible member 144 into alignment with a corresponding one of the recesses 146 in the uphole axial end of the retaining ring 136, and the spring force created by deflection of each flexible member will urge each flexible member 144 into the corresponding recess 146.

Figure 4:
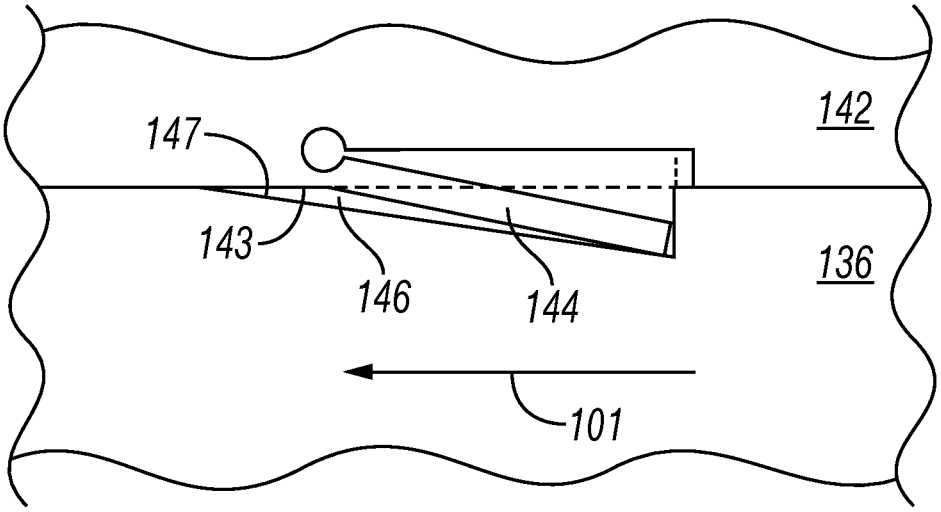
FIG. 4 is an enlarged view of a portion of the apparatus shown in FIG. 2.

Such engagement between the flexible members 144 and the recesses 146 is further shown in FIG. 4, which is an enlarged view of a portion of FIG. 2. The flexible member 144, having been urged by the deflective spring force into the recess 146, prevents unthreading rotation of the retaining ring 136, as depicted in FIG. 4 by arrow 101. However, during assembly of the stabilizer assembly 100, while the retaining ring 136 is being threaded onto the tubular member 102 in the direction opposite the arrow 101, the slanted bottom 147 of the recess 146 urges the flexible member 144 towards the deflected position (depicted by dashed lines in FIG. 4) flush with the surface 143, thus permitting the rotation of the retaining ring 136 relative to the sliding ring 142.

Returning to FIGS. 2 and 3, the stabilizer sleeve 104 may further comprise one or more openings 122 extending through the wall of the stabilizer sleeve 104 (i.e., between the inner and outer surfaces 120, 118). Each opening 122 may be elongated or otherwise shaped, and may be located between the blades 124 and/or at other locations. The openings 122 may be utilized during cleaning operations after the stabilizer assembly 100 is returned to the surface. For example, a stream of pressurized water may be directed into the openings 122 to evacuate or wash out drilling fluid and other debris that is trapped between the tubular member 102 and the stabilizer sleeve 104.

Figure 5:
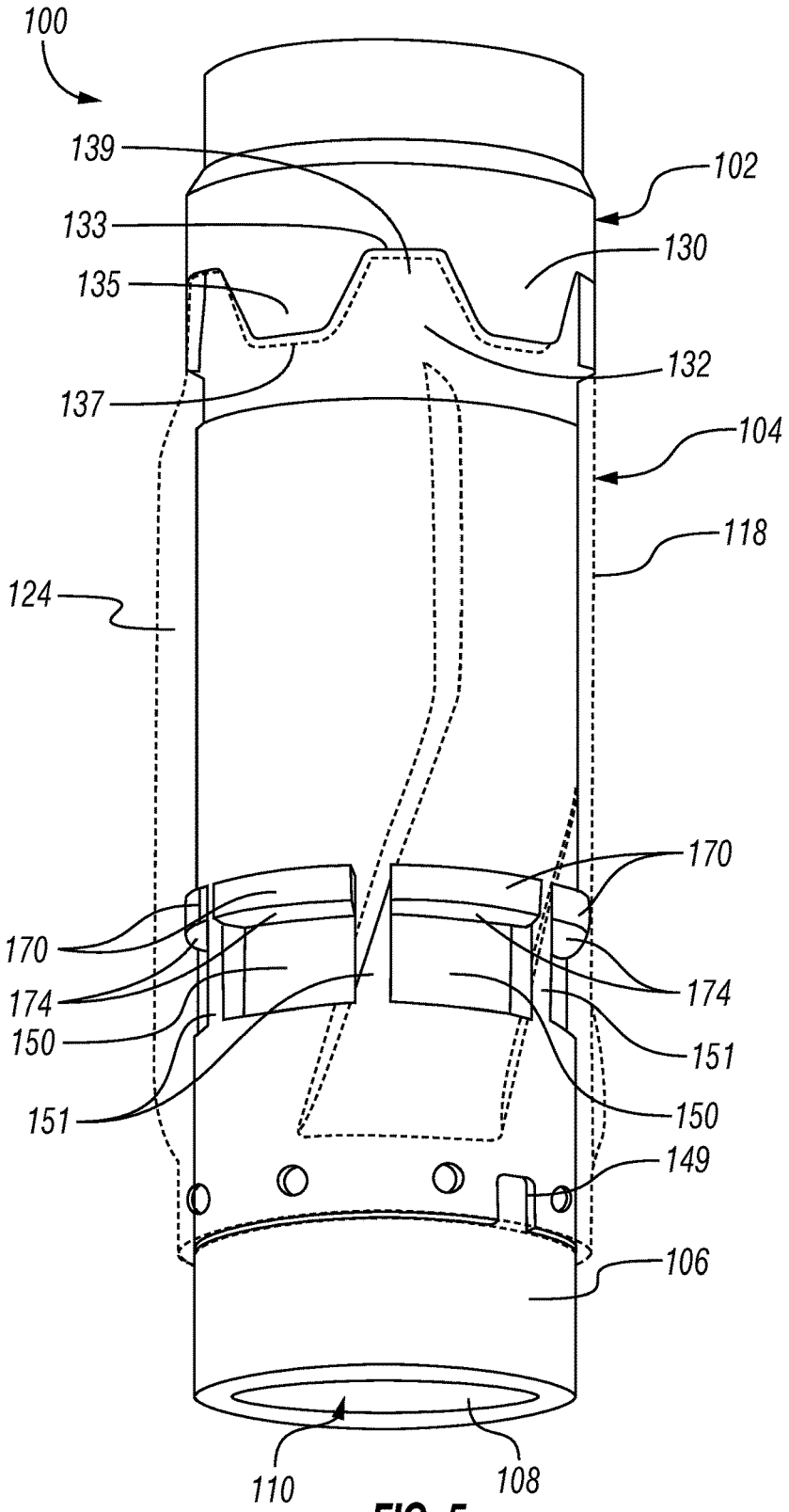
FIG. 5 is another perspective view of a portion of the apparatus shown in FIG. 2.
Figure 6:
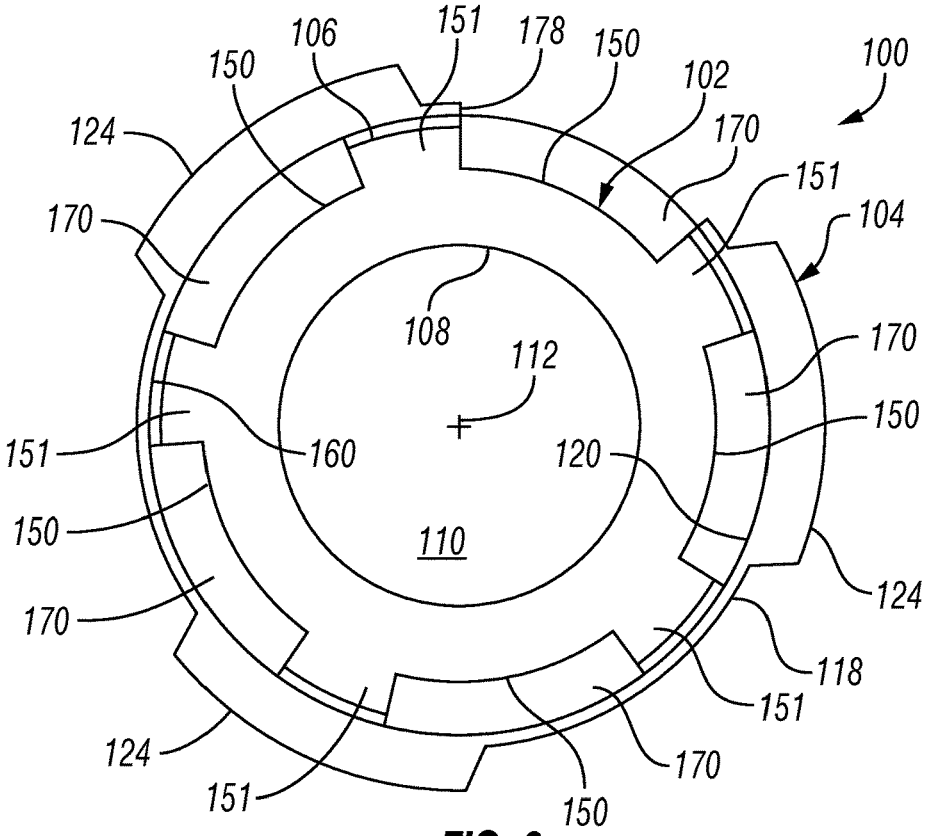
FIG. 6 is a sectional view of the apparatus shown in FIG. 2 taken along the section lines shown in FIG. 3.

FIG. 5 is another perspective view of a portion of the stabilizer assembly 100 shown in FIGS. 2 and 3, in which the stabilizer sleeve 104 is depicted in dashed lines. FIG. 6 is a sectional view of the stabilizer assembly 100 shown in FIG. 2 taken along the section lines shown in FIG. 3. The following description refers to FIGS. 2, 3, 5, and 6, collectively.

The tubular member 102 also comprises a plurality of recesses 150 extending into the outer surface 106 of the tubular member 102 and distributed circumferentially about the outer surface 106 of the tubular member 102. The recesses 150 may be separated from each other by dividers 151 extending axially along the outer surface 106 of the tubular member 102. Each recess 150 may be generally rectangular, defined at least partially by opposing upper and lower shoulders 152, 154 extending radially along the outer surface 106 between neighboring dividers 151. Corresponding pairs of the upper and lower shoulders 152, 154 define an axial length 156 of each recess 150

Although five recesses 150 are depicted in the example implementation shown in the figures, the tubular member 102 may comprise another number of recesses 150. Instead of multiple recesses 150, the tubular member 102 may comprise a continuous channel extending circumferentially around the tubular member 102, such that a single upper shoulder 152 and a single lower shoulder 154 each extend continuously around the outer surface 106.

The stabilizer sleeve 104 also comprises a continuous groove 160 extending circumferentially along the inner surface 120 of the stabilizer sleeve 104. The groove 160 may be defined by opposing upper and lower shoulders 162, 164 extending radially along the inner surface 120 and continuously around a circumference of the inner surface 120. An axial length 166 of the groove 160, defined between the upper and lower shoulders 162, 164, is substantially smaller than the axial length 156 of the recesses 150. At least a portion of the lower shoulder 164 may comprise a contact surface 165 that is substantially frustoconical or otherwise tapered with respect to the axis 112 of the stabilizer assembly 100.

The recesses 150 and the groove 160 at least partially define a plurality of annular spaces 168 between the tubular member 102 and the stabilizer sleeve 104. Each annular space 168 receives a corresponding key 170. Each key 170 contacts corresponding features of the groove 160 and a corresponding recess 150. For example, a radially outward portion of each key 170 is received within the groove 160, and a radially inward portion of each key 170 is received within a corresponding recess 150.

The keys 170 may be formed of a material that is substantially the same or similar as the material forming the tubular member 102 and the stabilizer sleeve 104. However, the tubular member 102 and the stabilizer sleeve 104 may comprise a material that is substantially harder and/or substantially more resistant to abrasion than the material forming the keys 170. The relatively softer material forming the keys 170 may permit the keys 170 to deform and/or wear out at a faster rate than the tubular member 102 and the sleeve 104. Therefore, the keys 170 may limit or reduce damage and/or wear experienced by the tubular member 102 and the sleeve 104 due to contact with the keys 170 and, thus, prolong the functional or service life of the tubular member 102 and the sleeve 104.

Figure 7:
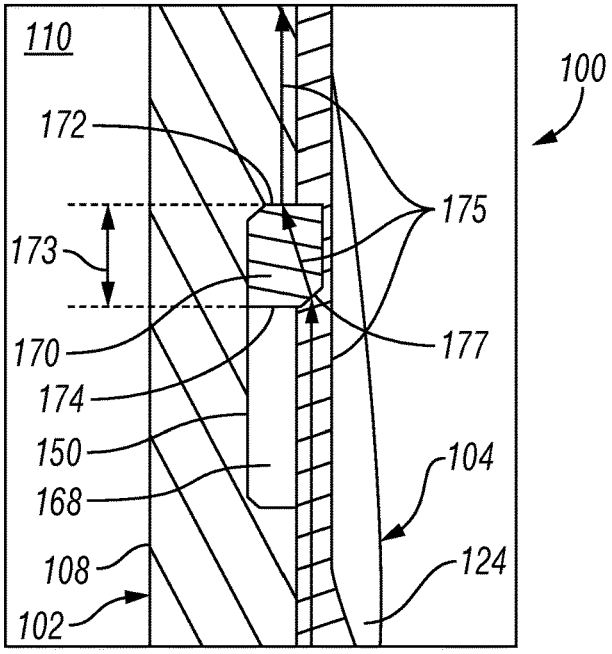
FIG. 7 is an enlarged view of a portion of the apparatus shown in FIG. 3.

FIG. 7 is an enlarged view of the stabilizer assembly 100 shown in FIG. 3. The following description refers to FIGS. 2, 3, 6, and 7, collectively.

Each key 170 may be a generally annular member having a substantially rectangular cross-sectional area, having upper and lower surfaces 172, 174 contacting corresponding features of the groove 160 and the recesses 150 and defining an axial length 173. The lower surface 174 of each key 170 may comprise a contact surface 177 that is tapered with respect to the axis 112, such as in a manner corresponding to the tapered contact surface 165 of the lower shoulder 164. The axial length 156 of the recesses 150 is substantially greater than the axial length 173 of the keys 170, such that the keys 170 may move axially within the corresponding recesses 150 during assembly.

For example, the stabilizer sleeve 104 also comprises an opening 178 extending through the wall of the stabilizer sleeve 104 (i.e., between the inner and outer surfaces 120, 118). The opening 178 is elongated or otherwise shaped to allow the passage of one of the keys 170. The opening 178 is located between two of the blades 124 at the axial position of the groove 160, such that the opening 178 is the projection of a portion of the groove 160 through the wall of the stabilizer sleeve 104.

During assembly of the stabilizer assembly 100, the stabilizer sleeve 104 is moved along the tubular member 102 to a first axial position (not shown) at which the castellated portions 130, 132 are not engaged, and at which the opening 178 is circumferentially aligned with one of the recesses at or proximate the lower shoulder 154 of the recess 150. With the stabilizer sleeve 104 at the first position, a key 170 is inserted through the opening 178 into recess 150. The stabilizer sleeve 104 is then rotated at the first axial position, such that the key 170 slides in the groove 160. This process is repeated to insert the other keys 170 into the remaining recesses 150. The stabilizer sleeve 104 is then rotated and moved axially to a second axial position to engage the castellated portions 130, 132, as shown in the figures. Because the keys 170 are axially captured within the groove 160, the axial movement of the stabilizer sleeve 104 from the first axial position to the second axial position causes the keys 170 to slide within the recesses 150 away from the lower shoulders 154 of the recesses 150 and into contact with the upper shoulders 152. Thereafter, the sliding ring 142 is placed around the tubular member 202 and moved into contact with the downhole end of the stabilizer sleeve 104, including engaging the tabs 148 of the sliding ring 142 with the recesses 149 of the stabilizer sleeve 104. The retaining ring 136 is then threadedly engaged with the tubular member 102 and tightened against the sliding ring 142.

Such assembly compresses the keys 170 between the upper shoulder 152 of the recesses 150 of tubular member 102 and the lower shoulder 164 of the groove 160 of the stabilizer sleeve 104, thus limiting or preventing movement of the stabilizer sleeve 104 in an uphole direction relative to the tubular member 102. That is, although the castellated portions 130, 132 may be engaged to limit or prevent rotation of the stabilizer sleeve 104 relative to the tubular member 102, the keys 170 prevent axial movement of the stabilizer sleeve 104 relative to the tubular member 102, thus reducing or preventing axial load transfer via contact between the castellated portions 130, 132. In other words, the keys 170 may prevent or reduce the protrusions 135, 139 of the castellated portions 130, 132 from bottoming out within the corresponding slots 133, 135.

For example, after the stabilizer assembly 100 has been assembled, the castellated portions 130, 132 may be separated by a space 131 ranging between about 3 millimeters (mm) and about 6 mm. Such spacing may prevent or reduce the transfer of axial forces from the stabilizer sleeve 104 to the tubular member 102 via the castellated portions 130, 132 during downhole operations. Thus, uphole-directed axial forces resulting from contact between the stabilizer sleeve 104 and the wellbore may be transferred from the stabilizer sleeve 104 to the tubular member 102 along an axial load path 175 extending through the shoulders 152, 164 and the keys 170, instead of through the castellated portions 130, 132. FIG. 7 is an enlarged view of a portion of FIG. 3 depicting the axial load path 175. Damages on the castellation portions may then be reduced, therefore, increasing the life of the stabilizer assembly 100. Further, the keys 170, constituting the part of the tool that would undergo most of the damages, may be easily replaced. Because the contact surfaces 177 of the keys 170 make contact with the contact surface 165 of the lower shoulder 164, the load path 175 also extends through the contact surfaces 165, 177. Downhole-directed axial forces resulting from contact between the stabilizer sleeve 104 and the wellbore may be transferred from the stabilizer sleeve 104 to the tubular member 102 through the sliding ring 142 and the retaining ring 136.

Figure 8:
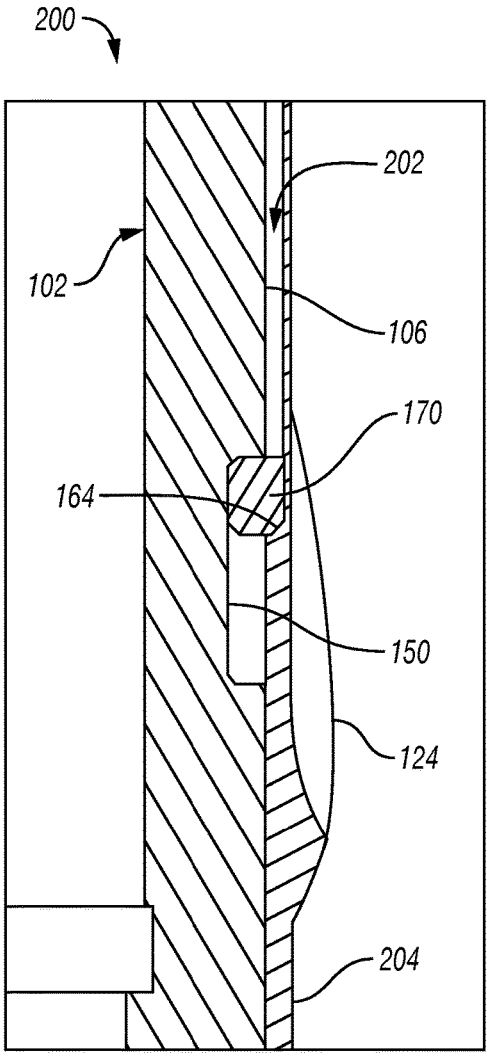
FIG. 8 is an enlarged view of another example implementation of the apparatus shown in FIG. 7.

FIG. 8 is a sectional view of another example implementation of the stabilizer assembly 100 shown in FIG. 7, designated in FIG. 8 by reference numeral 200, according to one or more aspects of the present disclosure. Unless described otherwise, the stabilizer assembly 200 is substantially similar to the stabilizer assembly 100, including where indicated by like reference numbers. For example, like the stabilizer assembly 100, the stabilizer assembly 200 comprises the tubular member 102, the blades 124, the recesses 150, and the keys 170. The stabilizer sleeve 204 of the stabilizer assembly 200 is also substantially similar to the stabilizer sleeve 104, except that the stabilizer sleeve 204 does not comprise a groove 160 defined between the upper and lower shoulders 162, 164, but instead comprises a bore 202 having the same diameter as the groove 160 and extending from the lower shoulder 164 to the uphole end of the stabilizer sleeve 204. During assembly, the keys 170 may be positioned in the recesses 150, and then the bore 202 may be moved over the keys 170 until the lower shoulder 164 of the bore 202 moves the keys 170 into contact with the upper shoulders 152 of the recesses 150. Accordingly, the keys 170 may be assembled within the stabilizer assembly 200 without utilizing the opening 178.

Figure 9:
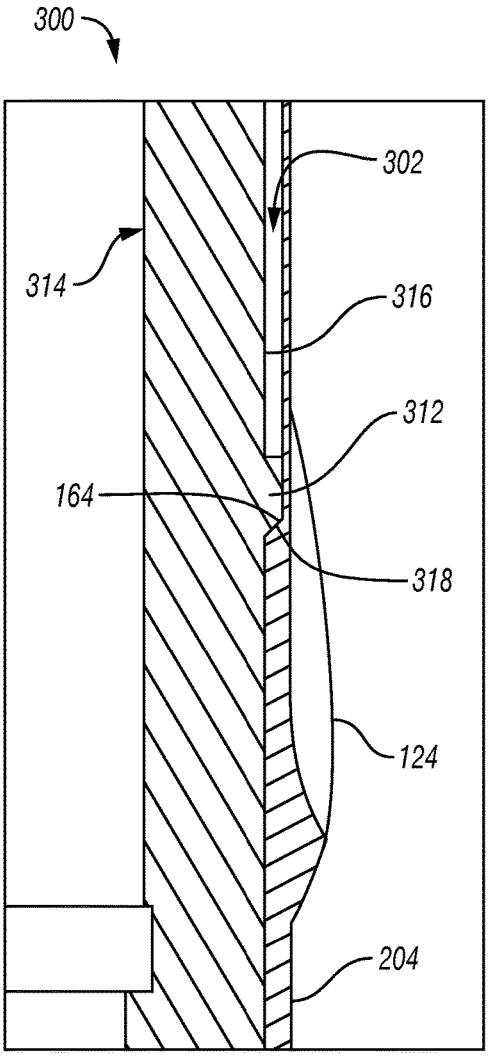
FIG. 9 is an enlarged view of another example implementation of the apparatus shown in FIG. 7.

FIG. 9 is a sectional view of another example implementation of the stabilizer assembly 100 shown in FIG. 8, designated in FIG. 9 by reference numeral 300, according to one or more aspects of the present disclosure. Unless described otherwise, the stabilizer assembly 300 is substantially similar to the stabilizer assembly 200, including where indicated by like reference numbers. For example, the stabilizer assembly 300 does not comprise the removable keys 170. Instead, the stabilizer assembly 300 comprises one or more keys 312 that are fixedly connected or integrally formed with the tubular member 314. The tubular member 314 may otherwise be substantially similar to the tubular member 102 described above. The one or more keys 312 may comprise one or more protruding features extending radially outward and circumferentially along an outer surface 316 of the tubular member 314. The one or more keys 312 may comprise a shoulder or contact surface 318 operable to contact the lower shoulder 164 to transfer axial force from the stabilizer sleeve 204 to the tubular member 314, similarly as described above.

Figure 10:
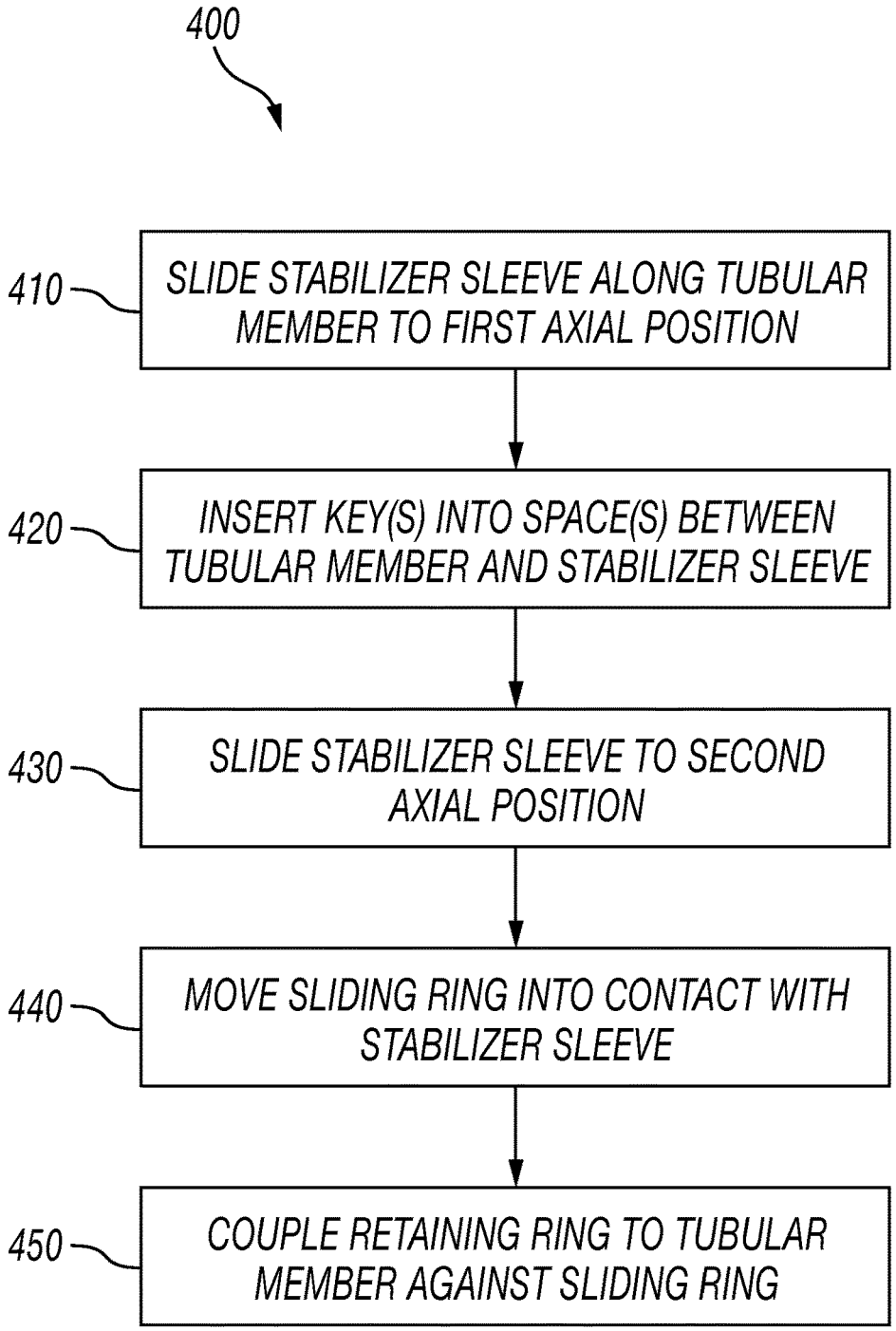
FIG. 10 is a flow-chart diagram of at least a portion of an example implementation of a method according to one or more aspects of the present disclosure.

FIG. 10 is a flow-chart diagram of at least a portion of an example implementation of a method (400) according to one or more aspects of the present disclosure. The method (400) may be performed to assemble the stabilizer assembly 100 shown in FIGS. 2-7. Thus, the following description refers to FIGS. 2-7 and 10, collectively. However, it is understood that one or more aspects of the method (400) are also applicable or readily adaptable for assembling the stabilizer assembly 200 shown in FIG. 8, the stabilizer assembly 300 shown in FIG. 9, and/or other stabilizer assemblies also within the scope of the present disclosure.

The method (400) comprises sliding (410) the stabilizer sleeve 104 axially along the tubular member 102 to a first axial position (not shown but described above). A key 170 is inserted (420) into an at least partially annular space 168 between the tubular member 102 and the stabilizer sleeve 104 while the stabilizer sleeve 104 is at the first axial position. The stabilizer sleeve 104 is then slid (430) axially along the tubular member 102 to a second axial position, as shown in FIGS. 2-7, at which the key 170 contacts the upper shoulder 152 extending externally around at least a portion of the tubular member 102, and the lower shoulder 164 extending internally around the stabilizer sleeve 104.

As described above, inserting (420) the key 170 into the annular space 168 may comprise inserting multiple keys 170 into corresponding annular spaces 168 while the stabilizer sleeve 104 is at the first axial position. For example, inserting each of the keys 170 into the annular spaces 168 may comprises: while the stabilizer sleeve 104 is in a first rotational orientation at the first axial position, inserting a first one of the keys 170 into one of the annular spaces 168 through the opening 178 extending radially through a wall of the stabilizer sleeve 104; rotating the stabilizer sleeve 104 to a second rotational orientation at the first axial position; inserting a second one of the keys 170 through the opening 178 and into another annular space 168 while the stabilizer sleeve 104 is at the second rotational orientation at the first axial position; and rotating the stabilizer sleeve 104 to each of a plurality of additional rotational orientations at the first axial position and, while the stabilizer sleeve 104 is at each of the additional rotational orientations, inserting another of the keys 170 through the opening 178 and into corresponding annular spaces 168, such that the first, second, and other keys 170 are each positioned within an annular space 168 at the corresponding first, second, and additional rotational orientations.

As also described above, sliding (430) the stabilizer sleeve 104 along the tubular member 102 to the second axial position may also comprise rotating the stabilizer sleeve 104 around the tubular member 102 such that the castellated portion 130 extending externally around the tubular member 102 aligns with the castellated portion 132 of the stabilizer sleeve 104, and such that moving the stabilizer sleeve 104 to the second axial position engages the castellated portions 130, 132, thereby limiting rotation of the stabilizer sleeve 104 relative to the tubular member 102.

The method (400) may also comprise moving (440) the sliding ring 142 extending around the tubular member 102 into contact with the stabilizer sleeve 104, including positioning the tab 148 extending longitudinally from the sliding ring 142 within the corresponding recess 149 of the stabilizer sleeve 104, and fixedly coupling (450) the retaining ring 136 to the tubular member 102 such that the retaining ring 136 extends around the tubular member 102 and contacts the sliding ring 142 opposite the stabilizer sleeve 104. As also described above, the axial end of the sliding ring 142 adjacent the retaining ring 136 may comprise one or more flexible members 144, and after fixedly coupling (450) the retaining ring 136 to the tubular member 102, the flexible members 144 may be urged by spring force into the recesses 146 in the otherwise substantially planar surface substantially forming the axial end of the retaining ring 136 adjacent the sliding ring 142, thus limiting relative rotation of the sliding ring 142 and the retaining ring 136.

In view of the entirety of the present disclosure, including the figures and the claims, a person having ordinary skill in the art should readily recognize that the present disclosure introduces a stabilizer assembly for incorporation in a drill string and comprising a tubular member and a stabilizer sleeve slidably disposed about the tubular member, the tubular member comprising a first castellated portion extending externally around the tubular member, and the stabilizer sleeve comprising a second castellated portion engaging the first castellated portion, wherein: the tubular member further comprises a first shoulder extending externally around at least a portion of the tubular member; the stabilizer sleeve further comprises a second shoulder extending internally around at least a portion of the stabilizer sleeve; the first and second shoulders at least partially define an annular space between the tubular member and the stabilizer sleeve; and the stabilizer sleeve further comprises a key disposed within the annular space such that an axial load path between the tubular member and the stabilizer sleeve is substantially through the first and second shoulders and the key and substantially not through the first and second castellated portions.

The key may contact the first and second shoulders and thereby limit axial movement of the stabilizer sleeve relative to the tubular member.

The key may comprise a first contact surface, the second shoulder may comprise a second contact surface contacting the first contact surface, the first and second contact surfaces may be tapered with respect to a longitudinal axis of the stabilizer assembly, and the axial load path may extend through the first and second contact surfaces.

The stabilizer assembly may further comprise a groove extending around an inner surface of the stabilizer sleeve and defined by the second shoulder and a third shoulder extending along the inner surface of the stabilizer sleeve, wherein the key may be partially received within the groove and may protrude radially inward from the groove beyond the inner surface of the stabilizer sleeve.

The stabilizer assembly may further comprise a recess extending along an outer surface of the tubular member and defined by the first shoulder and a fourth shoulder extending along the outer surface of the tubular member, wherein the key may be partially received within the recess and may protrude radially outward from the recess beyond the outer surface of the tubular member. "fourth shoulder" has been designated as such for clarity's sake but it is not always in combination with a "third shoulder", ie the stabilizer assembly may comprise a "fourth shoulder" and not a "third shoulder".

The stabilizer sleeve may comprise a radially extending opening through which the key may be inserted into the annular space during assembly of the stabilizer sleeve onto the tubular member. The opening may be offset, in particular angularly offset, from the key after assembly of the stabilizer sleeve onto the tubular member.

The stabilizer assembly may further comprise a sliding ring extending around the tubular member and adjacent the stabilizer sleeve opposite the second castellated portion, wherein the sliding ring may comprise a tab extending longitudinally into a corresponding recess of the stabilizer sleeve.

The stabilizer assembly may further comprise a retaining ring extending around the tubular member and adjacent the sliding ring opposite the stabilizer sleeve, wherein the retaining ring may be fixedly coupled to the tubular member.

The stabilizer assembly may comprise a plurality of the keys each disposed within the annular space, and the axial load path may be substantially through the first and second shoulders and at least one of the plurality of keys.

The tubular member may comprise a plurality of dividers longitudinally extending externally along the tubular member, the first shoulder may be one of a plurality of first shoulders each extending externally around the outer surface of the tubular member between neighboring ones of the plurality of dividers, the annular space may be a plurality of annular spaces each defined by the second shoulder and a corresponding one of the plurality of first shoulders between the tubular member and the stabilizer sleeve, and each of the plurality of keys may be disposed within a corresponding one of the plurality of annular spaces.

The present disclosure also introduces a method of assembling a stabilizer assembly, wherein the stabilizer assembly is for incorporation in a drill string and comprises a tubular member and a stabilizer sleeve, and wherein the method comprises: sliding the stabilizer sleeve axially along the tubular member to a first axial position; inserting a key into an at least partially annular space between the tubular member and the stabilizer sleeve while the stabilizer sleeve is at the first axial position; and sliding the stabilizer sleeve axially along the tubular member to a second axial position at which the key contacts: a first shoulder extending externally around at least a portion of the tubular member; and a second shoulder extending internally around at least a portion of the stabilizer sleeve.

The key may be one of a plurality of keys, and inserting the key into the annular space may comprise inserting each of the keys into the annular space while the stabilizer sleeve is at the first axial position. Inserting each of the keys into the annular space may comprise: while the stabilizer sleeve is in a first rotational orientation at the first axial position, inserting a first one of the keys into the annular space through an opening extending radially through a wall of the stabilizer sleeve; rotating the stabilizer sleeve to a second rotational orientation at the first axial position; inserting a second one of the keys through the opening and into the annular space while the stabilizer sleeve is at the second rotational orientation at the first axial position; and rotating the stabilizer sleeve to each of a plurality of additional rotational orientations at the first axial position and, while the stabilizer sleeve is at each of the additional rotational orientations, inserting another of the keys through the opening and into the annular space, such that the first, second, and other keys are each positioned within the annular space at the corresponding first, second, and additional rotational orientations.

Sliding the stabilizer sleeve along the tubular member to the second axial position may also comprise rotating the stabilizer sleeve around the tubular member such that a first castellated portion extending externally around the tubular member aligns with a second castellated portion of the stabilizer sleeve, and such that moving the stabilizer sleeve to the second axial position may engage the first and second castellated portions, thereby limiting rotation of the stabilizer sleeve relative to the tubular member.

The method may further comprise: moving a sliding ring extending around the tubular member into contact with the stabilizer sleeve opposite the second castellated portion, including positioning a tab extending longitudinally from the sliding ring within a corresponding recess of the stabilizer sleeve; and fixedly coupling a retaining ring to the tubular member such that the retaining ring extends around the tubular member and contacts the sliding ring opposite the stabilizer sleeve. An axial end of the sliding ring adjacent the retaining ring may comprise a flexible member. Prior to fixedly coupling the retaining ring to the tubular member, the flexible member may have a natural position in which the flexible member protrudes from an otherwise substantially planar surface substantially forming the axial end of the sliding ring, and the flexible member may be deflectable towards a deflected position in which the flexible member is flush within the otherwise substantially planar surface, thereby creating a spring force urging the flexible member towards the natural position. After fixedly coupling the retaining ring to the tubular member, the flexible member may be urged by the spring force into a recess in an otherwise substantially planar surface substantially forming an axial end of the retaining ring adjacent the sliding ring, thus limiting relative rotation of the sliding ring and the retaining ring.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A stabilizer assembly for incorporation in a drill string and comprising a tubular member and a stabilizer sleeve slidably disposed about the tubular member, the tubular member comprising a first castellated portion extending externally around the tubular member, and the stabilizer sleeve comprising a second castellated portion engaging the first castellated portion, wherein:

the tubular member further comprises a first shoulder extending externally around at least a portion of the tubular member;

the stabilizer sleeve further comprises a second shoulder extending internally around at least a portion of the stabilizer sleeve;

the first and second shoulders at least partially define an annular space between the tubular member and the stabilizer sleeve; and the stabilizer sleeve further comprises a key disposed within the annular space such that an axial load path between the tubular member and the stabilizer sleeve is substantially through the first and second shoulders and the key and substantially not through the first and second castellated portions.

2. The stabilizer assembly of claim 1 wherein the key contacts the first and second shoulders and thereby limits axial movement of the stabilizer sleeve relative to the tubular member.

3. The stabilizer assembly of claim 1 wherein the key comprises a first contact surface, the second shoulder comprises a second contact surface contacting the first contact surface, the first and second contact surfaces are tapered with respect to a longitudinal axis of the stabilizer assembly, and the axial load path extends through the first and second contact surfaces.

4. The stabilizer assembly of claim 1, further comprising a groove extending around an inner surface of the stabilizer sleeve and defined by the second shoulder and a third shoulder extending along the inner surface of the stabilizer sleeve, wherein the key is partially received within the groove and protrudes radially inward from the groove beyond the inner surface of the stabilizer sleeve.

5. The stabilizer assembly of claim 1, further comprising a recess extending along an outer surface of the tubular member and defined by the first shoulder and a fourth shoulder extending along the outer surface of the tubular member, wherein the key is partially received within the recess and protrudes radially outward from the recess beyond the outer surface of the tubular member.

6. The stabilizer assembly of claim 1, wherein:

the stabilizer sleeve comprises a radially extending opening through which the key is inserted into the annular space during assembly of the stabilizer sleeve onto the tubular member; and the opening is offset, in particular angularly offset, from the key after assembly of the stabilizer sleeve onto the tubular member.

7. The stabilizer assembly of claim 1 further comprising:

a sliding ring extending around the tubular member and adjacent the stabilizer sleeve opposite the second castellated portion, wherein the sliding ring comprises a tab extending longitudinally into a corresponding recess of the stabilizer sleeve; and a retaining ring extending around the tubular member and adjacent the sliding ring opposite the stabilizer sleeve, wherein the retaining ring is fixedly coupled to the tubular member.

8. The stabilizer assembly of claim 1 wherein the stabilizer assembly comprises a plurality of the keys each disposed within the annular space, and wherein the axial load path is substantially through the first and second shoulders and at least one of the plurality of keys.

9. The stabilizer assembly of claim 8 wherein:

the tubular member comprises a plurality of dividers longitudinally extending externally along the tubular member;

the first shoulder is one of a plurality of first shoulders each extending externally around the outer surface of the tubular member between neighboring ones of the plurality of dividers;

the annular space is a plurality of annular spaces each defined by the second shoulder and a corresponding one of the plurality of first shoulders between the tubular member and the stabilizer sleeve; and each of the plurality of keys is disposed within a corresponding one of the plurality of annular spaces.

10. A method of assembling a stabilizer assembly, wherein the stabilizer assembly is for incorporation in a drill string and comprises a tubular member and a stabilizer sleeve, comprising:

sliding the stabilizer sleeve axially along the tubular member to a first axial position;

inserting a key into an at least partially annular space between the tubular member and the stabilizer sleeve while the stabilizer sleeve is at the first axial position; and sliding the stabilizer sleeve axially along the tubular member to a second axial position at which the key contacts:

a first shoulder extending externally around at least a portion of the tubular member; and a second shoulder extending internally around at least a portion of the stabilizer sleeve.

11. The method of claim 10 wherein:

the key is one of a plurality of keys; and inserting the key into the annular space comprises inserting each of the keys into the annular space while the stabilizer sleeve is at the first axial position.

12. The method of claim 11 wherein inserting each of the keys into the annular space comprises:

while the stabilizer sleeve is in a first rotational orientation at the first axial position, inserting a first one of the keys into the annular space through an opening extending radially through a wall of the stabilizer sleeve;

rotating the stabilizer sleeve to a second rotational orientation at the first axial position;

inserting a second one of the keys through the opening and into the annular space while the stabilizer sleeve is at the second rotational orientation at the first axial position; and rotating the stabilizer sleeve to each of a plurality of additional rotational orientations at the first axial position and, while the stabilizer sleeve is at each of the additional rotational orientations, inserting another of the keys through the opening and into the annular space, such that the first, second, and other keys are each positioned within the annular space at the corresponding first, second, and additional rotational orientations.

13. The method of claim 10 wherein sliding the stabilizer sleeve along the tubular member to the second axial position also comprises rotating the stabilizer sleeve around the tubular member such that a first castellated portion extending externally around the tubular member aligns with a second castellated portion of the stabilizer sleeve, and such that moving the stabilizer sleeve to the second axial position engages the first and second castellated portions, thereby limiting rotation of the stabilizer sleeve relative to the tubular member.

14. The method of claim 10 further comprising:

moving a sliding ring extending around the tubular member into contact with the stabilizer sleeve opposite the second castellated portion, including positioning a tab extending longitudinally from the sliding ring within a corresponding recess of the stabilizer sleeve; and fixedly coupling a retaining ring to the tubular member such that the retaining ring extends around the tubular member and contacts the sliding ring opposite the stabilizer sleeve.

15. The method of claim 14 wherein:

an axial end of the sliding ring adjacent the retaining ring comprises a flexible member;

prior to fixedly coupling the retaining ring to the tubular member, the flexible member has a natural position in which the flexible member protrudes from an otherwise substantially planar surface substantially forming the axial end of the sliding ring, and the flexible member is deflectable towards a deflected position in which the flexible member is flush within the otherwise substantially planar surface, thereby creating a spring force urging the flexible member towards the natural position; and after fixedly coupling the retaining ring to the tubular member, the flexible member is urged by the spring force into a recess in an otherwise substantially planar surface substantially forming an axial end of the retaining ring adjacent the sliding ring, thus limiting relative rotation of the sliding ring and the retaining ring.

* * * * *